US011318480B2

(12) United States Patent
Dewicki et al.

(10) Patent No.: US 11,318,480 B2
(45) Date of Patent: May 3, 2022

(54) CENTRIFUGE FEED PIPES AND ASSOCIATED APPARATUS

(71) Applicant: Kennametal Inc., Latrobe, PA (US)

(72) Inventors: Grzegorz Dewicki, Greensburg, PA (US); Joshua T. Singley, Latrobe, PA (US); Pavel Ledyan, Bentonville, AR (US); John D. Robertson, Rogers, AR (US); Kevin M. Gamble, Stahlstown, PA (US)

(73) Assignee: KENNAMETAL INC., Latrobe, PA (US)

( * ) Notice: Subject to any disclaimer, the term of this patent is extended or adjusted under 35 U.S.C. 154(b) by 21 days.

(21) Appl. No.: 16/291,389

(22) Filed: Mar. 4, 2019

(65) Prior Publication Data

US 2020/0282408 A1 Sep. 10, 2020

(51) Int. Cl.

| | |
|---|---|
| ***F15D 1/02*** | (2006.01) |
| ***B04B 11/02*** | (2006.01) |
| ***B01F 15/02*** | (2006.01) |
| ***B01F 7/00*** | (2006.01) |

(52) U.S. Cl.
CPC ..... *B04B 11/02* (2013.01); *B01F 7/00908* (2013.01); *B01F 15/0201* (2013.01)

(58) Field of Classification Search
CPC ..... B04B 11/02; B01F 7/00908
USPC ..... 138/39, 42, 44
See application file for complete search history.

(56) References Cited

U.S. PATENT DOCUMENTS 1,608,547 A * 11/1926 Clark ..... F04D 29/448 415/189
1,662,178 A * 3/1928 Yuille ..... E02F 7/10 138/39
2,056,782 A * 10/1936 Fosdick ..... F16L 41/023 138/39
2,572,425 A * 10/1951 Andersson ..... C10G 31/10 494/37
3,228,594 A * 1/1966 Amero ..... B04B 1/20 494/23
3,566,922 A * 3/1971 Jouve ..... A47F 3/12 138/39
3,735,782 A * 5/1973 Strscheletzky ..... F04D 29/4273 138/39
3,910,715 A * 10/1975 Yedidiah ..... F04D 29/2277 415/182.1

(Continued)

FOREIGN PATENT DOCUMENTS

| | | |
|---|---|---|
| CN | 202803429 U | 3/2013 |
| CN | 202803436 U | 3/2013 |
| WO | WO2007119374 A1 | 10/2007 |

OTHER PUBLICATIONS

Sep. 21, 2020 Office Action (non-US) SE App. No. 2050225-8.

*Primary Examiner* — James F Hook
(74) *Attorney, Agent, or Firm* — Larry R. Meenan

(57) ABSTRACT

In one aspect, centrifuge feed pipes are described herein having design and architecture for mitigating wear during centrifuging operations. In some embodiments, a centrifuge feed pipe comprises a feed material inlet, a feed material outlet, and a conduit body extending along an axis between the feed material inlet and outlet, the conduit body having a variable inner diameter at one or more locations along the axis. In being variable, the inner diameter is not uniform over all radial positions of the inner diameter.

20 Claims, 3 Drawing Sheets

(56) References Cited

U.S. PATENT DOCUMENTS

| | | | | | |
|---|---|---|---|---|---|
| 3,934,614 | A * | 1/1976 | Elek | E02B 8/06 | 138/44 |
| 4,159,073 | A * | 6/1979 | Liller | B04C 5/02 | 138/39 |
| 4,869,713 | A | 9/1989 | Davier | | |
| 5,263,774 | A * | 11/1993 | Delcourt | B01F 7/0075 | 366/305 |
| 5,587,078 | A * | 12/1996 | LeBlanc | B04C 5/04 | 209/717 |
| 5,833,389 | A * | 11/1998 | Sirovich | B64C 21/10 | 405/52 |
| 7,399,412 | B2 * | 7/2008 | Keuschnigg | B04C 5/103 | 138/42 |
| 9,333,515 | B2 | 5/2016 | Reiff et al. | | |
| 9,931,643 | B2 | 4/2018 | Huyghe et al. | | |
| 2006/0243646 | A1 * | 11/2006 | Kucher | B04C 5/14 | 209/730 |
| 2018/0147582 | A1 * | 5/2018 | Casa | B04B 11/02 | |

* cited by examiner

CENTRIFUGE FEED PIPES AND ASSOCIATED APPARATUS

FIELD

The present invention relates to feed pipes for centrifuge apparatus and, in particular, to feed pipes having various architectures for inhibiting wear.

BACKGROUND

Centrifuges are employed in a variety of industrial applications for particle separation from fluids. Centrifuges find application in various water reclamation projects requiring particulate contaminant removal. In some embodiments, centrifuges find application in the mining industry for minimizing the environmental impact of operations heavily reliant on water. Water, for example, is used for bitumen extraction from oil sands. After the extraction process, the wastewater comprises sand, clay and other particulates. Fine clay particles and silt are generally too light for removal by sedimentation. Accordingly, fine particle content of the water can be substantially reduced via centrifugation.

Components of centrifuges can experience high wear due to particle flow across surfaces at high speeds and forces. Moreover, such wear is often non-uniform, thereby accelerating component failure. Wear resistant claddings have been applied to high wear components to increase lifetimes. However, claddings can be difficult to apply to internal surfaces and increase component costs.

SUMMARY

In view of these disadvantages, centrifuge feed pipes and associated centrifuge apparatus are described herein which, in some embodiments, exhibit designs and properties for mitigating wear. Briefly, a centrifuge feed pipe comprises a feed material inlet, a feed material outlet, and a conduit body extending along an axis between the feed material inlet and outlet, the conduit body having a variable inner diameter at one or more locations along the axis. In being variable, the inner diameter is not uniform over all radial positions of the inner diameter. FIG. 1, for example, illustrates one embodiment of a feed pipe comprising a variable inner diameter. As provided in FIG. 1, the inner diameter $D_1$ of the feed pipe at radial positions along the flattened section 11 differs from the inner diameter $D_2$ at radial positions outside the flattened section 11. This variable inner diameter can extend over a portion of the conduit body. Alternatively, the variable inner diameter can extend over the entire conduit body.

In another aspect, a centrifuge feed pipe comprises a feed material inlet, a feed material outlet, and a conduit body extending along an axis between the feed material inlet and outlet, the conduit body having a radially variable wall thickness. In some embodiments, for example, wall thickness of the conduit body is increased at radial positions normal or substantially normal to centrifugal forces experienced by the feed pipe during operation.

In a further aspect, a method of centrifuging comprises flowing a feed material through a feed pipe to a centrifuge chamber, the feed pipe comprising a feed material inlet, a feed material outlet, and a conduit body extending along an axis between the feed material inlet and outlet, the conduit body having a variable inner diameter at one or more locations along the axis.

These and other embodiments are further described in the following detailed description

DETAILED DESCRIPTION

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

In one aspect, centrifuge feed pipes are described herein having design and architecture for mitigating wear during centrifuging operations. In some embodiments, a centrifuge feed pipe comprises a feed material inlet, a feed material outlet, and a conduit body extending along an axis between the feed material inlet and outlet, the conduit body having a variable inner diameter at one or more locations along the axis. A feed material inlet generally refers to the area or region where feed material enters the centrifuge feed pipe. Similarly, a feed material outlet generally refers the area or region where the feed material exits the feed pipe.

In being variable, the inner diameter is not uniform over all radial positions of the inner diameter. In some embodiments, for example, the variable inner diameter has an oval cross-section and/or other changes in radius of curvature along the inner diameter perimeter. In other embodiments, the variable inner diameter can exhibit a curve-linear cross-section comprising one or more linear sections. The variable inner diameter can extend over a portion of the axis or extend over the entire axis. Moreover, in some embodiments, wall thickness between the inner and outer diameter of the conduit body is variable over at least a portion of the axis. Wall thickness of the conduit body, for example, can increase at radial positions normal or substantially normal to centrifugal force(s) experienced by the feed pipe. A radial position substantially normal to a centrifugal force can be within 20 degrees or within 10 degrees of the radial position where the centrifugal force is normal to the feed pipe wall.

Figure 1:
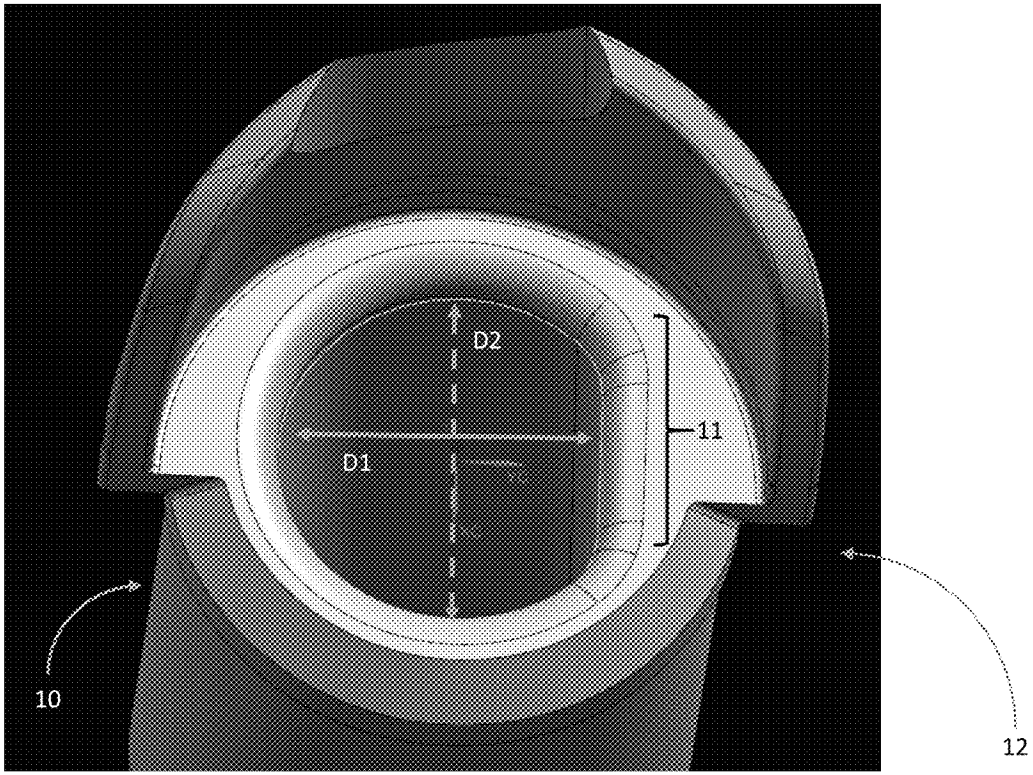
FIG. 1 is a perspective view of an inlet of a feed pipe having variable inner diameter according to one embodiment.

FIG. 1 illustrates a perspective view of an inlet 12 of a feed pipe having variable inner diameter according to one embodiment. As illustrated in FIG. 1, the curve-linear cross-section presents an inner diameter that is not uniform over all radial positions. The inner diameter $D_1$ of the feed pipe at radial positions along the flattened section 11 differs from the inner diameter $D_2$ at radial positions outside the flattened section 11. This variable inner diameter can extend over a portion of the conduit body. Alternatively, the variable inner diameter can extend over the entire conduit body. Additionally, wall thickness of the conduit body 10 is greater in the flattened section 11 relative to regions outside the flattened section 11. In some embodiments, one or more circular regions of the inner diameter can be concentric or non-concentric with the outer diameter surface.

The inner diameter may comprise one or more ridges extending along at least a portion of the axis, in some embodiments. One or more ridges can extend fully over the conduit body. Ridge(s) can occupy radial position(s) on the inner diameter normal or substantially normal to centrifugal forces experienced by the feed pipe. A ridge of the inner diameter can also define feed material troughs extending along the axis. Troughs defined by a ridge can have the same depth and/or profile, in some embodiments. In other embodiments, troughs defined by a ridge can have different depths and/or profiles. Additionally, the ridge and/or troughs can have uniform dimensions over a length of the axis. For example, ridge height and/or trough depth can be static over the entire axis or a portion thereof. Alternatively, one or more dimensions of the ridge and/or troughs can vary along the axis. In some embodiments, ridge height and/or trough depth can vary along the axis.

Figure 2:
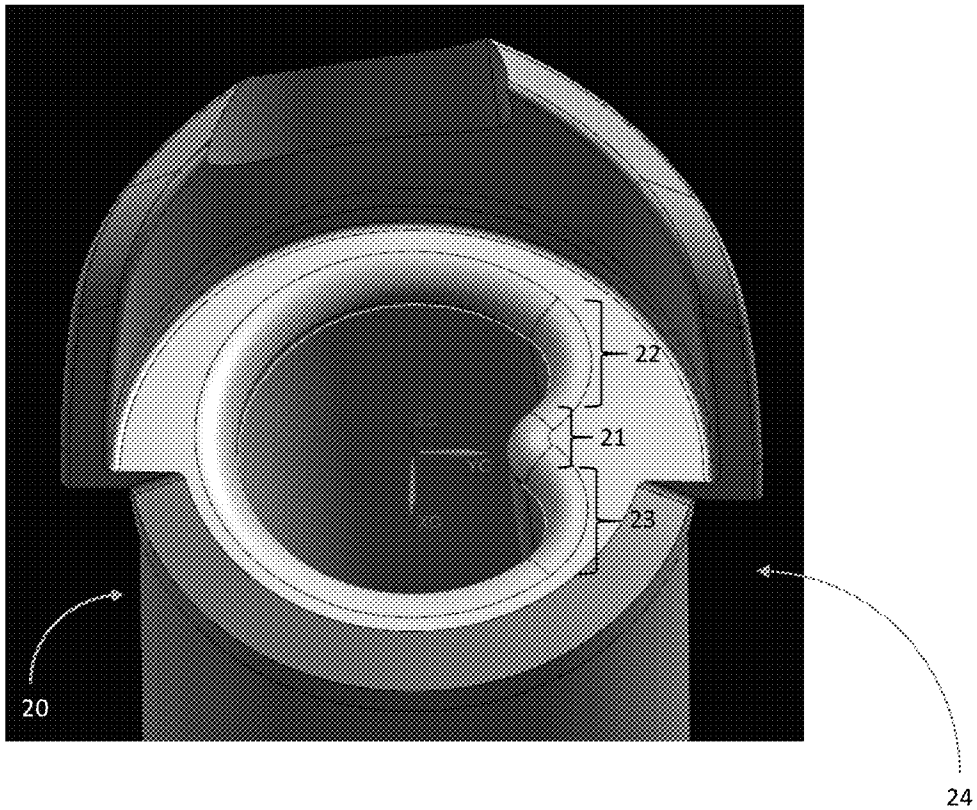
FIG. 2 is a perspective view of an inlet of a feed pipe having variable inner diameter according to one embodiment.

Troughs defined by a ridge can split or redirect the feed material flowing through the feed pipe. Splitting of the feed material can have a diffusing effect, thereby reducing wear concentrated at one or more regions of the feed pipe. FIG. 2 illustrates a perspective view of an inlet 24 of a feed pipe 20 wherein a ridge 21 extends along the inner diameter. As illustrated in FIG. 2, the presence of the ridge 21 provides troughs 22, 23 on either side of the ridge 21. Presence of the ridge 21 and associated troughs 22, 23 provide a variable inner diameter. Inner diameter at the ridge 21 varies from inner diameter at the troughs 22, 23 as well as from the circular regions outside the troughs 22, 23.

The inner diameter of a feed pipe described herein may also comprise one or more baffles having radial positioning and/or design to accumulate particles of the feed material. In some embodiments, one more baffles have an orientation normal to flow of feed material through the feed pipe. Baffles may also adopt an orientation of 20 to 80 degrees relative to the feed material flow. Moreover, the baffles may have periodic spacing or aperiodic spacing along the axis of the conduit body. The baffles are operable to accumulate particles of the feed material. Accumulation of such particles can generate a wear resistant layer, thereby enhancing lifetime of the feed pipe. The accumulation of particles can occur on the baffles and/or in regions between the baffles. The baffles can have any design, dimension and/or geometry consistent with particle accumulation and protective layer formation. In some embodiments, the baffles have the same design and/or dimensions. In other embodiments, the baffles may differ in one or more properties including, but not limited to, height and shape. Baffle design and properties can be selected according to a variety of considerations including position of the baffle in the feed pipe, feed material properties at the baffle position and/or desired particle accumulation effects provided by the baffle.

Figure 3:
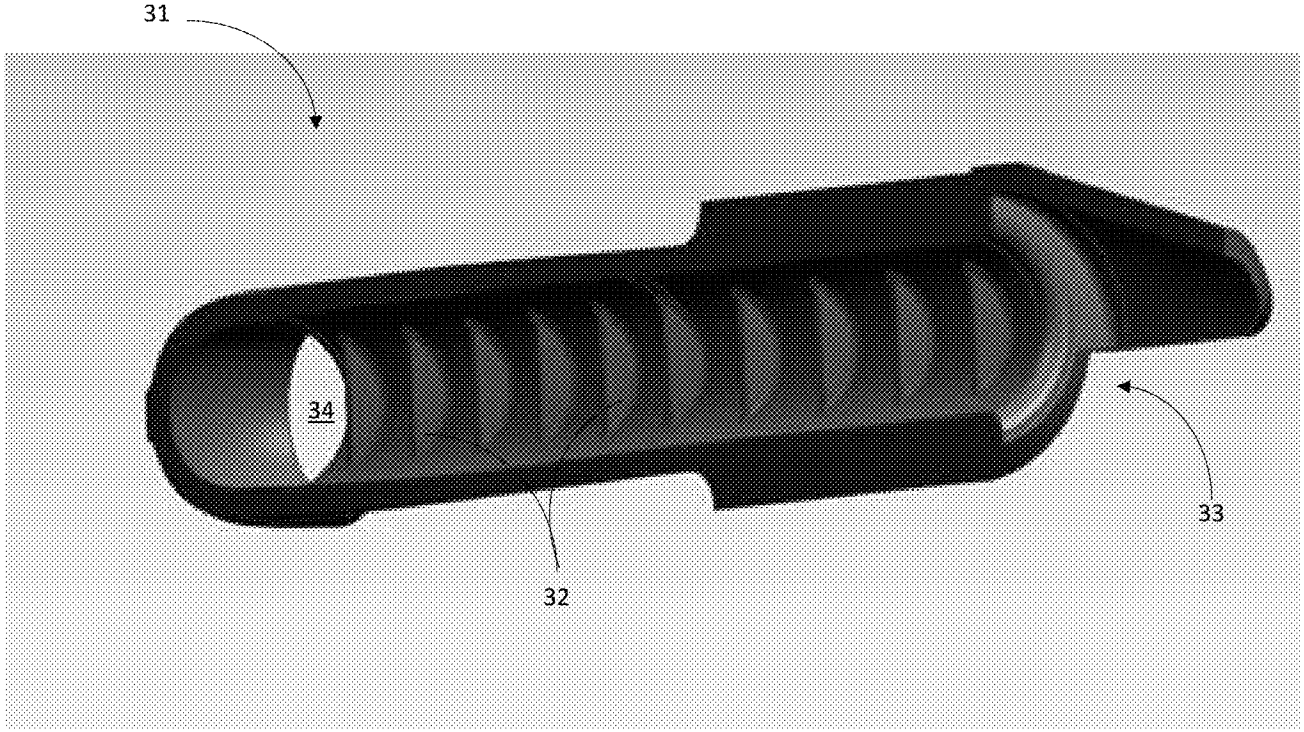
FIG. 3 is a cut-away perspective view of a feed pipe comprising baffles along the inner diameter according to some embodiments.

FIG. 3 is a cut-away perspective view of a feed pipe comprising baffles along the inner diameter according to some embodiments. As illustrated in FIG. 3, the baffles 32 have periodic spacing along an axis of the conduit body 31, the conduit body 31 extending between the feed material inlet 33 and feed material outlet 34. The baffles 32 also exhibit a radial position to accumulate particles of the feed material flow.

In another aspect, a centrifuge feed pipe comprises a feed material inlet, a feed material outlet, and a conduit body extending along an axis between the feed material inlet and outlet, the conduit body having a radially variable wall thickness. The variable wall thickness can extend over the entire conduit body or only a portion thereof. Moreover, wall thickness of the conduit body can increase at radial positions normal or substantially normal to centrifugal force(s) experienced by the feed pipe.

Feed pipes described herein can have any desired length and/or configuration. Length and/or configuration of a feed pipe can be selected according to various considerations including, but not limited to, type and volume of feed material, rotational speed and/or other dimensional requirements of the centrifuge apparatus in which the feed pipe is installed.

In another aspect, centrifuge apparatus are also provided. Centrifuge apparatus can comprise one or more feed pipes having any of the properties, features and/or designs described herein. In some embodiments, for example, feed pipes described herein are mounted on a rotating hub for feed material collection and passage in the centrifuge.

In a further aspect, methods of centrifuging are provided. A method of centrifuging comprises flowing a feed material through a feed pipe to a centrifuge chamber, the feed pipe comprising a feed material inlet, a feed material outlet, and a conduit body extending along an axis between the feed material inlet and outlet, the conduit body having a variable inner diameter at one or more locations along the axis. The feed pipe can have any of the properties, features and/or designs described herein. For example, the inner diameter of the feed pipe can comprise one or more baffles accumulating particles of the feed material. The accumulated particles can form a wear resistant layer over surfaces of the inner diameter, thereby enhancing lifetime of the feed pipe. In other embodiments, the feed pipe may comprise one or more ridges for redirecting flow of the feed material through the feed pipe. The one or more ridges can serve as a diffuser for spreading the feed material over a greater surface area of the feed pipe, thereby inhibiting or precluding the development of areas of concentrated wear within the feed pipe.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A centrifuge feed pipe comprising:

a feed material inlet, a feed material outlet, and a conduit body extending along an axis between the feed material inlet and outlet, the conduit body having a variable inner diameter located at a single radial position on the inner diameter, the single radial position within 20 degrees of a radial position where centrifugal force is normal to the conduit body during operation, and wall thickness between the inner diameter and an outer diameter of the conduit body is variable over at least a portion of the axis.

2. The feed pipe of claim 1, wherein the variable inner diameter has an oval cross-section.

3. The feed pipe of claim 1, wherein a cross-section of the variable inner diameter comprises one or more linear sections.

4. The feed pipe of claim 1, wherein the wall thickness increases at the radial position normal to centrifugal force experienced by the feed pipe.

5. The feed pipe of claim 1, wherein the variable inner diameter is present at the radial position over the entire axis.

6. The feed pipe of claim 1, wherein the variable inner diameter comprises one or more ridges extending over at least a portion of the axis.

7. The feed pipe of claim 6, wherein the one or more ridges define feed material troughs extending parallel to the axis and splitting feed material flow streams.

8. The feed pipe of claim 7, wherein the troughs have the same depth.

9. The feed pipe of claim 7, wherein the troughs extend to the outlet.

10. The feed pipe of claim 7, wherein the troughs have the same cross-sectional profile.

11. The feed pipe of claim 7, wherein the troughs have different cross-sectional profiles.

12. The feed pipe of claim 6, wherein the one or more ridges have uniform height.

13. The feed pipe of claim 6, wherein the one or more ridges have variable height.

14. The feed pipe of claim 1, wherein the variable inner diameter comprises one or more baffles to accumulate particles of the feed material at the radial position.

15. The feed pipe of claim 14, wherein the baffles have periodic spacing along the axis.

16. The feed pipe of claim 14, wherein the baffles have aperiodic spacing along the axis.

17. The feed pipe of claim 14, wherein the baffles have the same geometry along the axis.

18. The feed pipe of claim 14, wherein the baffles have different geometry along the axis.

19. The feed pipe of claim 14, wherein the baffles accumulate sufficient particles to inhibit wear of inner diameter surfaces.

20. The centrifuge food pipe of claim 1 comprising a flat wall extending between the inlet and outlet at the radial position.

* * * * *